United States Patent [19]

Hall et al.

[11] 4,354,359

[45] Oct. 19, 1982

[54] COLD STORAGE ASSEMBLY

[76] Inventors: Roger W. Hall, 27706 Nopales, Mission Viejo, Calif. 92690; John F. Lotterer, III, 23812 Via La Coruna, Mission Viejo, Calif. 92691

[21] Appl. No.: 222,588

[22] Filed: Jan. 5, 1981

[51] Int. Cl.[3] ..... F25D 19/00

[52] U.S. Cl. ..... 62/299; 62/337; 62/438; 62/457; 62/504; 62/526

[58] Field of Search ..... 62/457, 371, 372, 529, 62/530, 299, 337, 430, 438, 524, 525, 526; 251/149.6; 137/614.04

[56] References Cited

U.S. PATENT DOCUMENTS

| | | | |
|---|---|---|---|
| 1,185,597 | 5/1916 | Eddy | 62/504 X |
| 2,228,834 | 1/1941 | Kramer, Jr. | 62/504 X |
| 2,269,994 | 1/1942 | Sperry | 62/438 X |
| 2,328,874 | 9/1943 | Dillman | 62/504 X |
| 2,703,480 | 3/1955 | Riemenschneider | 62/438 X |
| 2,823,048 | 2/1958 | Hansen | 137/614.04 X |
| 3,507,322 | 4/1970 | Tetrick et al. | 62/299 |
| 3,850,006 | 11/1974 | Redfern et al. | 62/457 X |
| 3,858,405 | 1/1975 | Manzke | 62/337 X |
| 4,069,686 | 1/1978 | Hoelman | 62/299 X |
| 4,103,510 | 8/1978 | Hall | 62/457 X |

FOREIGN PATENT DOCUMENTS

| | | | |
|---|---|---|---|
| 525727 | 9/1921 | France | 62/526 |
| 1501411 | 10/1967 | France | 62/457 |

*Primary Examiner*—Lloyd L. King

*Attorney, Agent, or Firm*—Grover A. Frater

[57] ABSTRACT

A plug-in cold storage assembly capable of being moved from one insulated cabinet or chest to another, including at least two spaced "holdover" cold storage units and a mounting structure that holds the storage units in spaced relation and which completes flow connections between them and permits mounting in a cabinet or chest.

16 Claims, 9 Drawing Figures

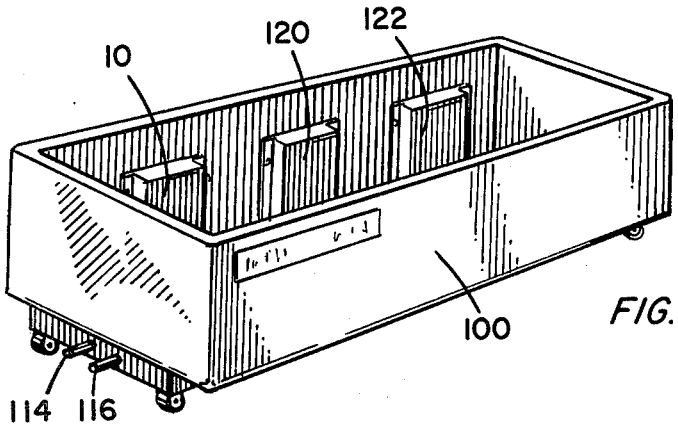
FIG. 5
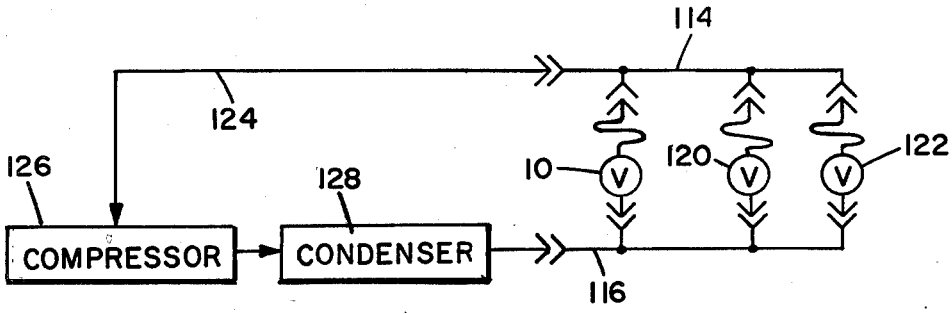
FIG. 6
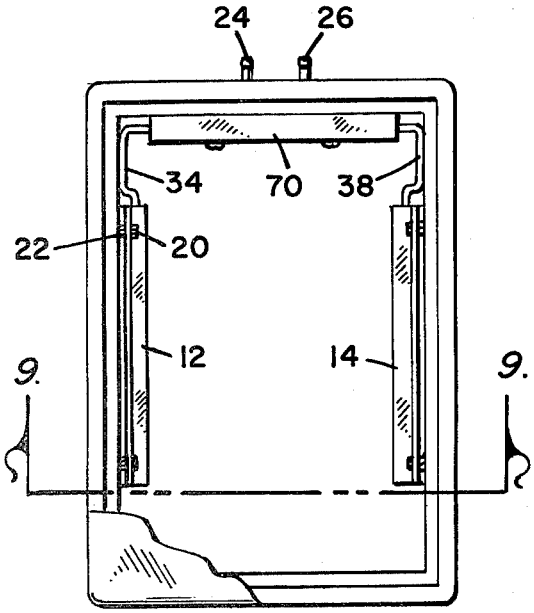
FIG. 8
FIG. 9
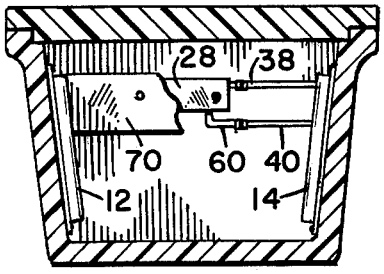
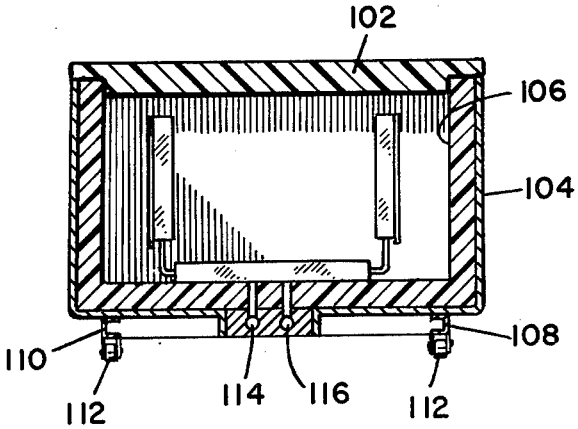
FIG. 7

COLD STORAGE ASSEMBLY

TECHNICAL FIELD

This invention relates to improvements in refrigeration apparatus, and it relates in particular to improvements in evaporator and expansion valves for refrigeration systems.

BACKGROUND OF THE INVENTION

In simplest form, a refrigeration system includes a body of refrigerant material whose state can be changed from gas to liquid and back to gas at practically achievable pressure and at temperatures near a desired temperature. The basic system includes a compressor in which the gaseous refrigerant is compressed and heated. It also includes a heat exchanger, called a condenser, in which the heat of compression is removed from the compressed gas, usually to atmosphere, and where the refrigerant becomes liquid. The condenser is followed in the refrigerant flow path by an expansion apparatus in which the compressed liquid is released into an apparatus where it is subjected to much lower pressure. The liquid can change state and expand, if heated. That circumstance is utilized by adding a second heat exchanger in the system. Called an "evaporator," the second heat exchanger is connected to receive refrigerant from the expansion apparatus. The refrigerant is returned from the evaporator to the compressor to complete the refrigeration circuit and the process cycle. In the process, heat is removed from the environment in the region of the evaporator and transferred to the environment in the region of the condenser.

In an extension of the basic system the process is used to produce and store "cold" whereby the production of cold can be separated in time from use of the cold.

There are several applications in which the time separation of cold production and cold utilization is combined with physical separation of the evaporator from the other elements of the system. The evaporator is combined structurally with the apparatus in which the cold is stored to form a cold storage unit, and the storage unit is made separable from the remainder of the system. An example is found in refrigerated trailer trucks where the compressor and condenser and expansion element are mounted on the tractor and the evaporator and cold storage structure is built into the trailer.

In another example, a cold storage unit is built into an insulated container. The unit and the insulated container are removably connected to the air conditioning system of a passenger car or recreational vehicle.

These examples serve to illustrate the feasibility of refrigeration systems in which cold produced in one place can be stored in a separable cold storage unit for use at a different time and place.

SUMMARY OF THE INVENTION

This invention provides a different arrangement for separability of the elements of a refrigeration system. One object is to provide a separable cold storage unit that provides greater versatility for the user and, in some situations, a more efficient unit at lower cost.

One of the features of the invention is the provision of two cold storage units which are spaced apart and have plate form in the preferred embodiment. The two units are interconnected by a rigid structure so that they occupy what are substantially opposed positions in parallel planes. In the preferred form, the two cold storage units have the evaporator of one unit connected in series with the evaporator of the other unit, and the rigid interconnecting structure includes the flow passages that accomplish the series connection.

Further, it is a feature of the preferred form of the invention that the interconnecting structure include a manifold by which the cold storage units and the interconnecting structure can be fixed to the interior of a thermally insulated chest or cabinet.

It is a further feature to include the expansion structure as part of the interconnecting structure such that it is disposed inside of the chest or cabinet when the cold storage units are mounted in a chest or cabinet.

The assembly of cold storage units and interconnecting structure includes connectors which interfit with connectors associated with the refrigerant flow lines of the remainder of the refrigeration system.

Some of the most cost effective, thermally insulating chest and cabinet materials are lacking in the ruggedness, surface qualities, and other physical characteristics that are required in a long lived, permanent cold storage container. The cold storage and expansion mechanism assembly of the invention can be moved from chest to chest. Inexpensive chests having a very high insulating quality can be considered to be expendable, or even disposable, because the cold storage units and expansion valve and connecting hardware can be transferred as a unitary assembly from one cabinet or chest to another.

To provide an assembly having one or more of these several features is another object of the invention.

Other objects and advantages of the invention will become apparent upon a reading of the description of preferred embodiments of the invention and upon an examination of the accompanying drawings. It is to be understood that the embodiments shown represent what are now believed to be the best mode for practicing the invention, but that other embodiments are possible.

THE DRAWINGS

In the drawings:

FIG. 5 is an isometric view of an uncovered insulated cabinet which includes three assemblies of the kind shown in FIG. 1;

FIG. 6 is a schematic diagram showing how the cold storage assemblies of FIG. 5 can be incorporated into a refrigeration system;

FIG. 7 is an end view of the unit of FIG. 5 including its cover and in which the cover and cabinet are shown at cross-section taken midway along the length of the cabinet and cover;

FIG. 8 is a top view of an insulating chest in which a cold storage assembly, like the assembly of FIG. 1, is mounted, a fragment of the chest cover being shown;

FIG. 9 is a cross-sectional view taken on line 9—9 of FIG. 8.

BRIEF DESCRIPTION OF THE PREFERRED EMBODIMENTS

The cold plate assembly of the invention includes at least two cold storage units. Each of those units includes an evaporator which is a heat exchanger for transferring heat from the surrounding environment to a refrigerant material which flows through the heat exchanger. The invention includes a means for connecting the two cold storage units in series between a pair of connectors which are arranged for connection to the refrigerant lines of an apparatus required to complete a refrigeration system. In addition, the invention includes a means for holding the two or more cold storage units spaced from one another. In the preferred form of the apparatus, the elements that complete the flow path for refrigerant, and the elements that hold the cold storage units in spaced relation, comprise the same structural elements. Moreover, in the preferred embodiment, the two cold storage units lie in somewhat parallel planes in a position so that one is substantially opposed to the other, and the elements that define the flow path for refrigerant and that hold the cold storage elements in spaced relation are disposed not between the two cold storage units. In the preferred embodiment, that structure occupies a position in a plane that does not extend through either of the cold storage units but is perpendicular to the two planes in which the cold storage units are disposed.

Figure 1:
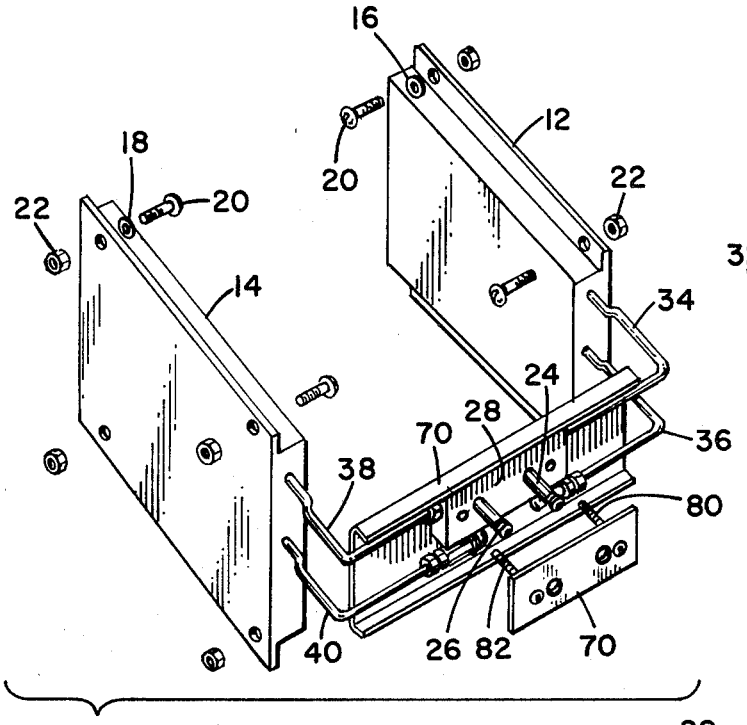
FIG. 1 is an exploded, isometric view of the preferred embodiment of a cold storage assembly according to the invention.

Such an assembly is shown in FIG. 1 where it is generally designated by the reference numeral 10. One of its cold storage units is designated 12 and the other is designated 14. In the form shown, these cold storage elements are known in the trade as "cold plates." They are relatively thin, have substantially uniform thickness over their entire length and breadth, and are usually rectangular in shape. They are called "plates" because they ordinarily are much less wide than they are long or high. Each consists of an outer shell or container. Inside is a length of tubing which serves as a conduit or flow path for a refrigerant material. The tubing is woven to and fro within the housing so that the path length for refrigerant through the housing is extended. The space within the housing and around the tubing is filled, or more properly, nearly filled, with a cold storage material often called a "holdover" material. Examples are salt water and pure water. In the cold storage plates 12 and 14, the cold storage material is pure water. The numerals 16 and 18 identify water fill holes in plates 12 and 14, respectively. More properly, the numerals 16 and 18 designate the closures which seal the fill holes with which they are associated, respectively.

Whether plate fasteners are used in a particular application depends upon whether the cold plates are to be free standing or fixed to the inner walls of an insulated container whose interior is to be cooled. The preferred embodiment includes a means for securing the two cold plates to the container walls. That means includes a number of fasteners, two of which are designated 20 in FIG. 1, and spacers, two of which are designated 22 in FIG. 1. The fasteners 20 are designed to extend through openings in edge lips formed integrally with the cold plate housing, and to extend through the spacers and into the walls of the cabinet within which this assembly is to be mounted. The advantage of the fasteners and spacers will be explained below.

Figure 2:
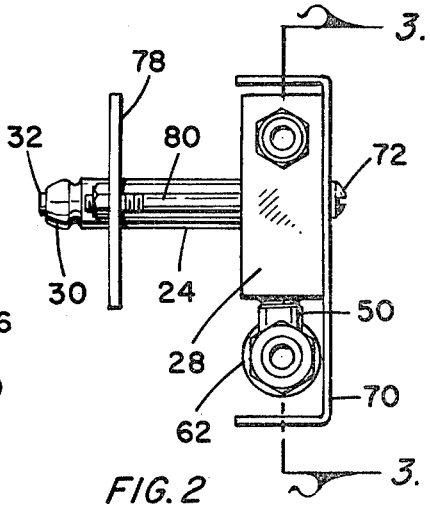
FIG. 2 is a view in side elevation of the manifold and expansion valve and related elements that are incorporated in the embodiment of FIG. 1.

The tubing within each of the two cold plates serves as an evaporator when the cold storage assembly is connected to, and forms part of, a complete refrigeration system. The numerals 24 and 26 identify flow tubes each of which is threaded at one end like a pipe nipple. The threaded end of each of the flow tubes is turned into the threaded receiving opening of a manifold 28. At its outer end, each of the flow tubes 24 and 26 ends in a quick disconnect which includes an internal check valve. The quick disconnect 30 at the end of flow tube 24 is shown in FIG. 2. The numeral 32 identifies the actuator of the check valve within the quick disconnect structure. What is shown is the male half of a pair of connectors each of which has an internal check valve. The two valves are actuated when the parts of the connector are brought together to afford fluid communication through the connection.

Instead of terminating at the exterior wall of the cold storage plates 12 and 14, the tubing that forms the evaporator in each of those units is extended beyond the cold plate housing, is shaped as shown in FIG. 1, and then is connected to the manifold 28. The upper tube emanating from cold plate 12 is numbered 34 for identification. The other end of that tube emerges from the cold plate and is numbered 36. In the case of cold plate 14, the tubing is numbered 38 where it emerges near the upper edge of the cold plate. The other end of the tube is numbered 40, and it emerges from the cold plate at a lower point. Both the tubing ends 38 and 40 are bent into a plane perpendicular to the plane of the cold plate, and ultimately are connected to the manifold 28.

Figure 3:
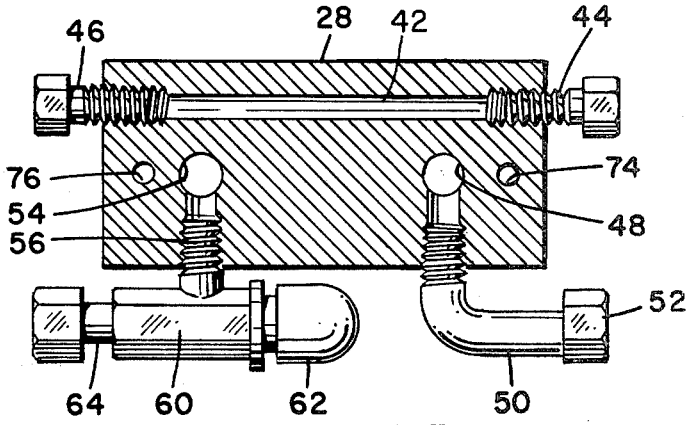
FIG. 3 is a front view of the manifold block and expansion valve in which the block is shown to be sectioned on line 3—3 of FIG. 2.

The manner of their interconnection can be understood by an examination of FIGS. 1 and 3. The manifold 28 is shown to include a rectangular block or body. A through opening extends from one end of the block to the other, shown in FIG. 3 where the opening is designated 42. The opening is threaded at its ends to receive a coupling element 44 on the right in FIG. 3, and a coupling element 46 at the left. When the unit is assembled, the tube end 34 of FIG. 1 is inserted into and is fixed to the coupling 44. The tube end 38 of cold plate 14 extends into, and is fixed to, the coupling 46. The manifold block opening into which tube 24 is threaded is numbered 48 in FIG. 3. It does not extend entirely through the block. Instead, it intersects with a bore formed from the bottom edge of the block and which is threaded to receive the threaded end of an elbow 50. The other end of the elbow is formed with a coupling element 52 which receives and which is fixed to the lower end 36 of the evaporator tubing of cold plate 12. The opening of the manifold block into which the threaded end of flow tube 26 is fixed is numbered 54. It does not extend entirely through the block. Instead, it intersects with a bore which opens to the lower edge of the manifold block and is threaded to receive the threaded extension 56 which extends to the side of a conventional, pressure actuated reducing valve 60. This valve serves as an expansion valve. It is conventional in form in that it has an orifice into which a tapered needle extends. The position of the needle can be adjusted to alter the amount of flow through the orifice. The position of the tapered needle is controlled by a spring biased diaphragm element which operates against the bias of the spring whose bias can be adjusted by rotation of the adjustment knob 62. While the preferred embodiment of the invention incorporates an automatically operative, thermally responsive valve, any number of commercially available valves may be used. It is preferred, as shown, to use a valve which can be assembled with the manifold block to form a rigid combination structure. At its outlet end the valve 60 is fitted with a connector 64 which is connected and fixed to the end of the tubing end 40 which extends from plate 14.

In a typical embodiment, the cold plate might measure 35 cm in length, 24 cm high, and 3 cm thick. In such a cold plate, the tubing which formed the evaporator and the ends of which extended from the cold plate would be formed of 1 cm inside diameter soft drawn copper tubing. The several connectors would be formed of brass, and the manifold plate itself would be formed of aluminum. The two plates might be separated by approximately 35 cm. It will be apparent in such a construction that the tubing and the manifold form a construction sufficiently rigid to provide a substantial amount of support for the two cold plates. Some additional support against excessive bending of the tubing is provided by the channel-shaped protective cover 70. The bottom wall of the channel is mounted flush against the rear face of the manifold block 28 by two machine screws, one of which, 72, is visible in FIG. 2. Those two machine screws thread into openings 74 and 76 which extend entirely through the manifold block 28 and are threaded from each side. The machine screws that hold down the protective cover 70 extend only a short distance into the block. The remainder of the length of the threaded hole is reserved to accommodate the threads of a pair of machine screws which extend through a mounting plate 78. When the assembly of FIG. 1 is to be mounted into an insulated cabinet or chest, two holes are formed through the wall of the chest. Those holes are spaced to accommodate the two flow tubes 24 and 26 which are to extend entirely through the wall of the chest or cabinet. The two larger holes in the mounting plate 78, which are visible in FIG. 1, are spaced so that the two holes can receive the outer ends of the two tubes 24 and 26. The plate 78 is placed against the outer surface of the cabinet or chest, and the plate is clamped to the manifold block 28 by driving a pair of screws 80 and 82, which have been inserted into the smaller openings of the plate, through the insulation of the chest or cabinet into the openings 74 and 76 of the manifold block. The manner in which the assembly of FIG. 1 is mounted in an insulated chest is illustrated in FIGS. 8 and 9.

Figure 4:
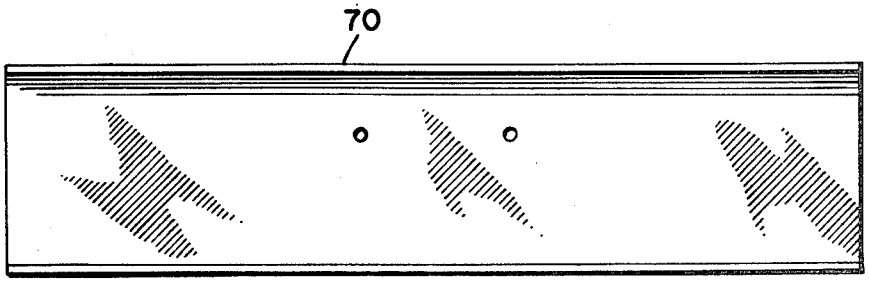
FIG. 4 is a view in elevation of the front side of the cover plate of FIGS. 1 and 2.

The protective cover 70 is shown in FIG. 4. In this embodiment it is made of a heavy plastic material that is easily cleaned and which, like the plastic housing of the two cold plates 12 and 14, is thermally conductive in relatively high degree. In embodiments where greater rigidity is required, the cover 70 is advantageously made of metal.

It is to be understood, of course, that the invention is not limited to cold plates of the conformation shown. Nor is the invention limited to an interconnecting structure comprising flow tubes and rectangular manifold block. The forms shown are preferred both because they provide a very convenient structure for clamping the cold plate assembly to a chest or cabinet and because the tubular construction permits minor spacing and dimensional adjustments.

The assembly of FIG. 1 can be incorporated into chests and cabinets of various sizes and shapes. Three assemblies are shown to be incorporated in the elongated cabinet of FIG. 5. The cabinet 100 thereshown is intended for use in a food market for displaying foodstuffs that must be kept cold. For example, just prior to the Thanksgiving holiday, the sales of frozen turkeys and cranberry sauces, and some other foodstuffs, can be expected to increase beyond normal. Rather than to rearrange the normal display of refrigerated foods, it may be desired to display the Thanksgiving foods separately. In the past, to do that it was necessary to move a complete refrigeration unit out of the sales floor to some location where an electrical outlet was available. Separate displays would require separate complete refrigeration units. The unit of FIG. 5 permits an alternative arrangement. The cabinet thereshown has an outer sheet metal shell and an inexpensive polystyrene inner liner. It has a transparent cover formed of a plastic material that is a poor conductor of heat. That construction is best shown in FIG. 7 where the cover is designated 102. The outer metallic casing is numbered 104, and the polystyrene liner is numbered 106. The casing 104 is mounted on a pair of channels 108 and 110, and the channels in turn are mounted on casters 112. A pair of fluid flow lines 114 and 116 are housed in insulating material in a channel that extends along the bottom of the cabinet throughout its length. At spaced points along their length the conduits 114 and 116 are fitted with quick disconnect units that mate with the quick disconnect connectors of flow tubes 24 and 26 of FIG. 1. In the embodiment of FIGS. 5 and 7, there are three sets of those quick disconnects fixed to flow lines 114 and 116, and they are arranged so that the unit of FIG. 1, and two others like it, are simply plugged into those flow lines. Then the cabinet is filled with the foodstuffs that are to be maintained cold. The unit is rolled to position in which the lines 114 and 116 can be connected to a compressor and condenser combination in the manner illustrated in the schematic diagram of FIG. 6. The assembly 10 and assemblies 120 and 122, which are similar to the assembly 10, are plugged into lines 114 and 116 in series. Line 114 connects to a line 124 which extends back to a compressor 126. The output of the compressor is delivered to a condenser 128 and the output of the condenser is hot compressed refrigerant which is applied by line 116 to the expansion valves of the three cold storage assemblies. That unit can be operated at other than the utility company's peak load time to store cold in the storage assemblies. The polystyrene is an exceptionally good insulator, and the foodstuffs in the cabinet can be expected to remain cold for many hours. At night, the cabinet 100 is wheeled out of the way, back to be reconnected to a compressor and condenser as a refrigerator unit, and the cold can be restored. The cabinet is out of the way so that it does not interfere with cleaning activities.

In applications where the interior of the cabinet is likely to become soiled, it may be preferred simply to remove the several cold storage assemblies, and then to remove and throw away the polystyrene liner. The liner is simply replaced with a fresh one. If that is not convenient, then a more permanent liner is employed.

There are many applications in which it is desirable to be able to remove the cold storage assembly from the insulated cabinet either to permit replacement of the cold storage units or to permit replacement of the cabinet. FIGS. 8 and 9 illustrate how the cold storage assembly can be applied to a small insulated chest.

It is possible to tap into the refrigerant flow lines of the air conditioning system of a motor vehicle. Flow lines are conducted from the air conditioning system back to the trunk of an automobile or to the space within a van. In prior art systems of that kind an expansion valve or a capilliary tube expansion mechanism is connected in series in one of the lines, and the two lines terminate in quick disconnect units which plug into mating disconnect units at the exterior of a removable insulated chest. In some cases the chest is formed with a built-in cold plate and, in some cases, the chest is provided with a multiple wall structure in which an evaporator and holdover material are contained. The invention can be used to provide a chest that performs a similar function. However, the unit of the invention is not built into the chest. It can be removed from one chest and be placed in another. It is required only to form openings in an end wall of a chest, insert the two flow tubes 24 and 26 through those openings, place the clamping plate over them and fix it in place. That can be done with a very inexpensive chest. If the chest becomes damaged, and ordinarily it is the exterior of the chest which is most abused and deteriorates first, it is a simple matter to remove the cold storage unit and to replace the chest. The structural form shown has a special advantage. The structure that interconnects the two plates serves as the mounting and separation structure as well as the structure which completes the flow path for the refrigerant material. The unit shown can be made very efficient. The two cold plates are held in place by the combination of the fasteners 20 and the spacers 22 of FIG. 1. The cold plate can be held away from the interior wall of the insulated container to minimize the transfer of heat to the cold plate through the container walls so that, to a greater extent, the loss of cold is occasioned by cooling of the contents of the chest.

Although we have shown and described certain specific embodiments of our invention, we are fully aware that many modifications thereof are possible. Our invention, therefore, is not to be restricted except insofar as is necessitated by the prior art.

We claim:

1. In combination:

a pair of cold storage units each comprising an evaporator having an inlet opening and an outlet opening;

a flow control manifold;

flow circuit interconnector means comprising two connectors for completing flow passages from said flow control manifold to each of a respectively associated one of two external refrigerant flow passages; and flow path completion and cold storage unit separation means for completing a flow path for refrigerant from one of said two connectors through said manifold and through the evaporators of said cold storage units in series and thence through said manifold to the other of said two connectors, and for holding said cold storage units spaced one from the other.

2. The invention defined in claim 1 in which said flow path completion and cold storage unit separation means includes a manifold which comprises a body in which at least two manifold flow paths are formed, one of said two manifold flow paths extending from one of said two connectors to a manifold outlet opening and the other of said manifold flow paths extending from the other of said two connectors to a manifold inlet opening.

3. The invention defined in claim 2 in which said manifold further comprises a through opening extending between a through opening inlet and a through opening outlet.

4. The invention defined in claim 3 in which said flow path completion and storage unit separation means comprises rigid elements which define a flow path affording fluid communication between the evaporator of one of said cold storage units and the through opening inlet and manifold outlet opening of the manifold, and which elements define a flow path affording fluid communication between the evaporator of the other of said cold storage units and the manifold inlet opening and the through opening outlet of the manifold.

5. The invention defined in claim 1 in which said flow path completion and storage unit separation means includes an expansion valve in said flow path for refrigerant at a point upstream from said evaporators.

6. The invention defined in claim 4 in which said flow path completion and storage unit separation means includes an expansion valve connected in series with said flow path affording fluid communication between said manifold outlet opening and said one of said cold storage units, said expansion valve being responsive to different pressures to preclude and to permit fluid communication through said flow path.

7. The invention defined in claim 4 in which said rigid elements of the flow path completion and storage means are effective to hold said cold storage units in spaced substantially parallel planes.

8. The invention defined in claim 7 in which said rigid elements are positioned substantially in opposition and in which said manifold comprises a body disposed at one side of said cold storage elements.

9. The invention defined in claim 8 in which said body of said manifold lies in a plane which is perpendicular to said substantially parallel planes of the cold storage units.

10. The invention defined in claim 9 which further comprises an insulated container having inner walls which define a rectangularly-shaped interior and having opposed side walls and an end wall;

said cold storage units being disposed each adjacent to a respectively associated one of said side walls and said manifold being disposed adjacent to said end wall at the interior of said container; and further comprising means for clamping said manifold to said end wall.

11. The invention defined in claim 9 in which said expansion valve lies in the plane of said manifold within the interior of said insulated container.

12. The invention defined in claim 11 in which each of said cold storage units comprises a container for a body of cold storage material whose smallest dimension is its width in the direction away from the side wall of the insulated container adjacent to which it is disposed.

13. The invention defined in claim 10 in which each of said cold storage units is fixed to, but spaced from, its associated side wall of said insulated container.

14. A combined evaporator and expansion valve unit for installation in containers formed of thermally insulating material, said unit comprising:

a pair of spaced cold storage plates each including an evaporator in thermal communication with a body of cold storage material;

an expansion valve;

a pair of flow line connectors of the kind that include a check valve actuated by connection and disconnection of the connector;

an interconnecting means for completing a fluid flow path extending from one to the other of said connectors through the series combination of said expansion valve and the evaporators of one and then the other of said cold storage plates; and said interconnecting means comprising means for holding said cold storage plates in fixed, relative spaced relationship, and a manifold having a flat surface lying in a plane perpendicular to, and midway between, said cold storage plates and rigid conduit extending between said manifold and said storage plates.

15. The invention defined in claim 14 which further comprises means for fixing said unit in the interior of an insulated container by clamping said flat surface of said manifold to an interior surface of such an insulated container.

16. The invention defined in claim 15 in which said expansion valve is fixed to said manifold for mounting with the manifold at the interior of the container.

* * * * *